US005749798A

United States Patent [19]

Kuebler et al.

[11] Patent Number: 5,749,798

[45] Date of Patent: May 12, 1998

[54] RACKET FOR TENNIS OR THE LIKE GAMES

[75] Inventors: Siegfried Kuebler, Uberlingen, Germany; Frank Garrett, Barrington, Ill.

[73] Assignee: Wilson Sporting Goods Co., Chicago, Ill.; a part interest

[21] Appl. No.: 700,734

[22] Filed: Aug. 15, 1996

[51] Int. Cl.[6] ..... A63B 49/08

[52] U.S. Cl. ..... 473/549

[58] Field of Search ..... 473/549, 551, 473/538, 463, 173, 183

[56] References Cited

U.S. PATENT DOCUMENTS

| | | | |
|---|---|---|---|
| 4,575,082 | 3/1986 | Mott et al. . | |
| 4,943,058 | 7/1990 | Carbonetti | 473/552 X |
| 5,034,082 | 7/1991 | Nolan . | |
| 5,064,203 | 11/1991 | Hattori | 473/551 |

FOREIGN PATENT DOCUMENTS

| | | | |
|---|---|---|---|
| 550253 | 7/1993 | European Pat. Off. | 473/183 |
| 858205 | 5/1940 | France | 473/173 |
| 2366106 | 6/1978 | France | 473/173 |
| 2403172 | 5/1979 | France | 473/173 |
| 2573988 | 6/1986 | France | 473/173 |
| 2805315 | 8/1979 | Germany | 473/173 |
| 3625929 | 2/1988 | Germany | 473/183 |
| 170717 | 11/1921 | United Kingdom | 473/183 |
| 330243 | 6/1930 | United Kingdom | 473/173 |

*Primary Examiner*—Raleigh W. Chiu

[57] ABSTRACT

In a racket for tennis or the like games having a frame for receiving stringing and comprising a possibly hollow profile bar, and a handle end which is of polygonal cross-section and which is wound around with a grip strip and whose blank is provided at the corners of the cross-section with longitudinal edges separating each two longitudinal surfaces, the longitudinal edges are raised relative to their longitudinal surfaces. Preferably for that purpose longitudinal ribs extend at the longitudinal edges, the ribs being formed on the handle blank or being fixedly connected thereto in another manner.

18 Claims, 1 Drawing Sheet

RACKET FOR TENNIS OR THE LIKE GAMES

The invention concerns a racket for tennis or the like games, having a frame for receiving stringing, comprising a possibly hollow profile bar, as well as a handle which is polygonal in cross-section and which can be wound around with a grip strip and whose blank is provided at the corners of the cross-section with longitudinal edges which each separate two longitudinal surfaces.

A racket of that kind is to be found for example in the present applicant's U.S. Pat. No. 4,664,380. The tennis player who is familiar with the racket is possibly in a position to be aware of the position of the racket in his hand, because of the longitudinal edges of the handle blank, which he can feel.

As it is increasingly attempted to increase the thickness of the grip strip and to improve the damping properties of the racket, for example by cushioning, the longitudinal edges can no longer be felt and the user of the tennis racket does not have the above-indicated information.

In consideration of those factors the invention set himself the aim of retaining the information-supplying capability of a racket handle, even when using a relatively thick grip strip.

That object is attained by the teaching of the independent claim which involves making the longitudinal edges raised relative to their longitudinal surfaces.

In accordance with the invention, arranged at the longitudinal edges are longitudinal ribs which can extend over the entire length of the blank or only over a part of the blank.

By virtue of that configuration, the information relating to the position of the tennis racket can still be felt, even when using handles which are foam-encased.

The appendant claims set forth desirable configurations.

The longitudinal ribs according to the invention may be of different cross-sections, for example they may be bead-like or ridge-like, round or polygonal, and they may possibly also be of an undercut configuration.

Longitudinal ribs which are formed on the blank are in accordance with the invention, as also are those which are produced separately and which are joined to the blank by positively locking engagement, for example by means of insert pins, or by force-locking engagement, for example by means of adhesive.

It is also possible to produce separately made longitudinal ribs from a material which differs from that of the racket. It will be clear here that the handle structure—in the form of a solid profile portion, a hollow profile portion, foamed or the like—remains without any influence on the configuration according to the invention.

Further advantages, features and details of the invention will be apparent from the following description of preferred embodiments and with reference to the diagrammatic drawing in which.

Figure 1:
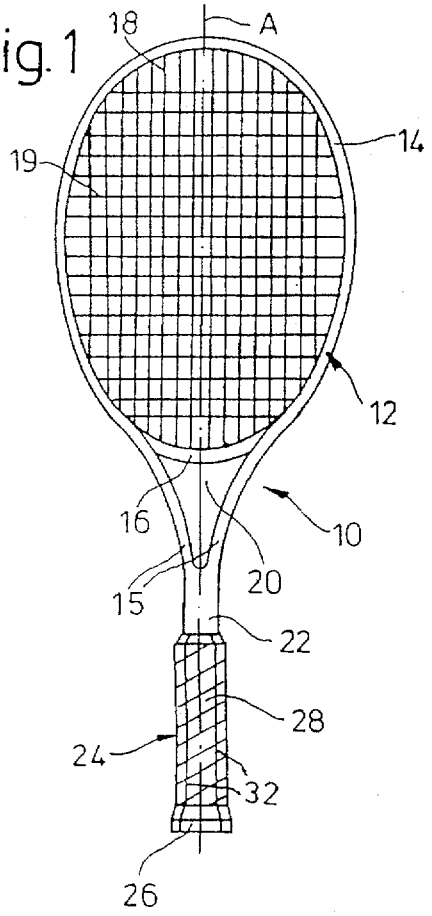
FIG. 1 is a plan view of a tennis racket with stringing frame, throat or heart zone and handle.

A tennis racket 10 has a stringing frame 12 comprising a profile bar 14 which is bent approximately to an oval shape, and a frame crosspiece 16 which completes that oval; arranged in the oval of the frame 12 is stringing comprising mutually crossing longitudinal and transverse strings 18 and 19 which pass through the frame 12 and the frame crosspiece 16.

Outside the frame 12 the two end portions 15 of the profile bar 14 laterally define a free area 20, which is triangular in plan view, of a throat or heart zone which has the end portions 15 and the frame crosspiece 16. At the ends thereof which are remote from the frame, on the axis A of the racket, the end portions 15 merge into a handle neck 22 which is adjoined by a handle 24 with a handle strip winding 28 which covers over a handle cap 26.

Figure 2:
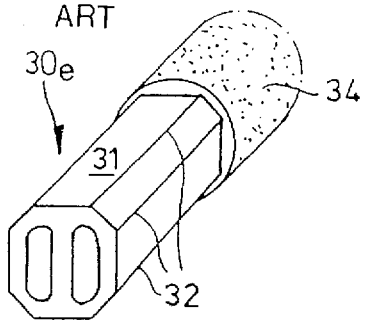
Fig. 2 PRIOR ART
FIG. 2 is a perspective view of a portion of a handle blank according to the prior art.

Under the handle strip winding 28 the handle blank **30*e* of the prior art shown in FIG. 2 is of octagonal cross-section and has eight longitudinal edges 32 between eight longitudinal surfaces 31**.

Figure 3:
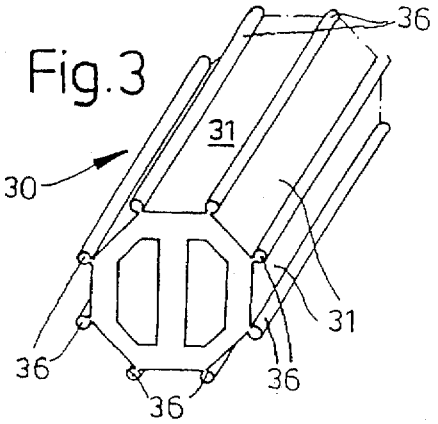
FIG. 3 is a perspective view of a handle blank according to the invention with longitudinal ribs.

Thick coverings are desired for damping reasons, for example a wrapping tape or strip as indicated at 34, with a foam back, of a thickness as indicated at a. In order to be able to supply the tennis player with information about the position of the handle 24 and thus the tennis racket 10 in the hand, the longitudinal edges 32 are accompanied as shown in FIG. 3 by longitudinal ribs 36 which can be felt even through relatively thick foam.

Figure 4:
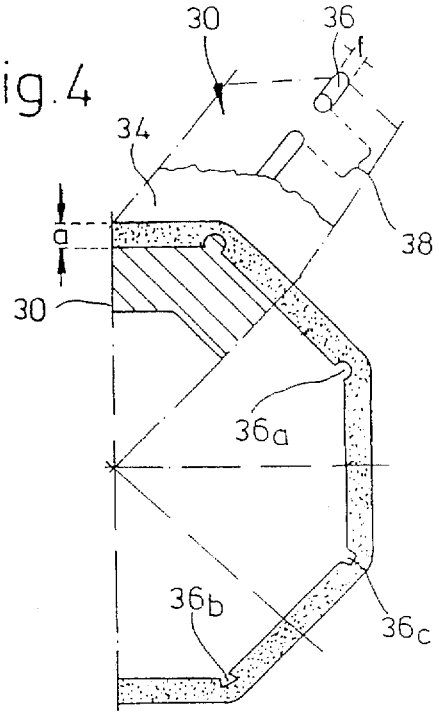
FIG. 4 shows examples of different cross-sections for the longitudinal ribs.

The longitudinal ribs 36 of a diameter as indicated at f can be continuous or—as indicated at 38 in FIG. 4—interrupted, or they can be formed on the handle or additionally mounted thereto. It is also possible to form them from material which is different from the racket material, for example metal portions.

FIG. 4 shows a plurality of cross-sectional shapes, illustrated for the sake of clarity of the drawing in the form of portions of the wrapping tape or strip 34, more specifically substantially round longitudinal ribs 36 with an undercut configuration, round longitudinal ribs $\mathbf{36}_a$ without an undercut configuration, undercut quadrangular ribs $\mathbf{36}_b$ and quadrangular ribs $\mathbf{36}_c$ which are of right-angled cross-sectional configuration or which taper outwardly. The quadrangular ribs $\mathbf{36}_b$ may also stand up at a right angle from their longitudinal surface 31, while the longitudinal ribs may also be of triangular cross-sections (not shown).

Figure 5:
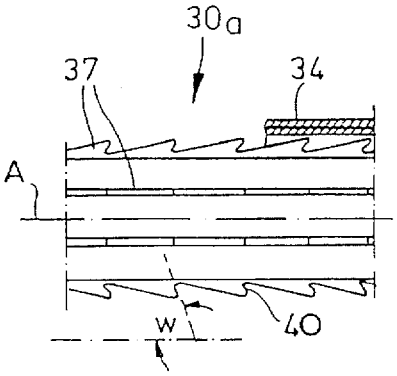
FIG. 5 shows a side view of a further handle blank with longitudinal ribs.

Finally the handle blank $\mathbf{30}_a$ in FIG. 5 has longitudinal ribs 37 of sawtooth-like longitudinal section, the ribs being diagrammatically shown in somewhat exaggerated form in FIG. 5; here the wrapping tape or strip 34 can hook on the almost radial tooth shoulders 40 of the longitudinal ribs 37 so that there is no need for an adhesive. Reference w denotes the angle of inclination of the tooth shoulders 40 relative to the racket axis A; it measures less than 90° and thus defines an undercut dimension in respect of the barb-like structure.

We claim:

1. A racket for tennis games having a frame (12) for accommodating stringing (18,19) and comprising a hollow profile bar (14) and a handle (24) which is of polygonal cross-section and which is wound around with a grip strip (28) and having a blank provided at the corners of the cross-section with longitudinal edges (32) separating each two longitudinal surfaces (31) of said blank, wherein longitudinal ribs (36, $\mathbf{36}_a$ to $\mathbf{36}_c$, 37) extend at the longitudinal edges (32) of the handle (24).

2. A racket as set forth in claim 1 wherein at least one of said longitudinal ribs (36, $\mathbf{36}_a$) is of part-circular cross-section.

3. A racket as set forth in claim 2 wherein said at least one longitudinal rib includes an undercut portion between said longitudinal rib and at least one of said longitudinal surfaces to receive a portion of said grip strip therein.

4. A racket as set forth in claim 1 wherein the cross-section of the longitudinal rib (36$_b$, 36$_c$) is of a polygonal configuration.

5. A racket as set forth in claim 4 wherein the longitudinal rib includes an undercut portion between said longitudinal rib and at least one of said longitudinal surfaces to receive a portion of said grip strip therein.

6. A racket as set forth in claim 4 wherein the longitudinal rib is of a quadrangular cross-section that is relatively narrow at a first side adjacent said longitudinal surfaces and gradually widens toward a second side opposite said longitudinal surfaces.

7. A racket as set forth in claim 1 wherein at least one of said longitudinal ribs is of a rectangular cross-section.

8. A racket as set forth in claim 7 wherein the longitudinal rib is of a quadrangular cross-section that is relatively narrow at a first side adjacent said longitudinal surfaces and gradually widens toward a second side opposite said longitudinal surfaces.

9. A racket as set forth in claim 4 wherein the longitudinal rib is of a triangular shape.

10. A racket as set forth in claim 1 wherein the longitudinal rib (37) is provided in its longitudinal extent with hook-like recesses (40).

11. A racket as set forth in claim 10 having a sawtooth-like longitudinal section of the longitudinal rib (37).

12. A racket set forth in claim 10 wherein the recesses (40) are inclined at an angle (w) relative to the longitudinal axis (A) of the racket.

13. A racket set forth in claim 1 wherein the longitudinal rib (36, 36$_a$ to 36$_c$, 37) is formed on the blank (30).

14. A racket as set forth in claim 1 wherein the longitudinal rib (36, 36$_a$ to 36$_c$, 37) is securely connected to the blank (30).

15. A racket as set forth in claim 1 wherein the longitudinal rib (36, 36$_a$ to 36$_c$, 37) is securely connected to the blank (30) by a force-fit.

16. A racket as set forth in claim 1 wherein the longitudinal rib (36, 36$_a$ to 36$_c$, 37) extends axially over a part of the blank (30).

17. A racket as set forth in claim 1 wherein the longitudinal rib (36, 36$_a$ to 36$_c$, 37) is interrupted (region 38).

18. A racket as set forth in claim 1 wherein the longitudinal rib (36, 36$_a$ to 36$_c$, 37) is made from metal.

* * * * *